US006767116B2

(12) United States Patent
Lupicki

(10) Patent No.: US 6,767,116 B2
(45) Date of Patent: Jul. 27, 2004

(54) LIGHTING FIXTURE ASSEMBLY

(75) Inventor: Joseph William Lupicki, Carthage, MO (US)

(73) Assignee: H.E. Williams, Inc., Carthage, MO (US)

( * ) Notice: Subject to any disclaimer, the term of this patent is extended or adjusted under 35 U.S.C. 154(b) by 28 days.

(21) Appl. No.: 10/255,010

(22) Filed: Sep. 24, 2002

(65) Prior Publication Data

US 2004/0057239 A1 Mar. 25, 2004

(51) Int. Cl.[7] ..... F21V 21/20
(52) U.S. Cl. ..... 362/401; 362/220; 362/404
(58) Field of Search ..... 362/217–225, 362/391, 401, 402, 404–408

(56) References Cited

U.S. PATENT DOCUMENTS 2,564,328 A * 8/1951 Farrington ..... 362/402
3,594,568 A * 7/1971 Guth, Jr. ..... 362/221
3,919,459 A * 11/1975 Van Steenhoven ..... 174/63
4,286,313 A * 8/1981 Quiogue ..... 362/404
4,837,669 A * 6/1989 Tharp et al. ..... 362/147
6,517,222 B1 * 2/2003 Orlov ..... 362/391

* cited by examiner

*Primary Examiner*—Alan Cariaso
(74) *Attorney, Agent, or Firm*—William C. Norvell, Jr.; Beirne, Maynard & Parsons, LLP

(57) ABSTRACT

A lighting fixture for mounting from a suspensory surface, such as a ceiling, wall, or the like, includes a counterweight for balancing or equalizing the weight in the fixture resulting from a ballast being positioned within the frame of the fixture. The weight of the frame is adjusted to equalization relative to the ballast for proper alignment during mounting of the lighting fixture.

5 Claims, 3 Drawing Sheets

LIGHTING FIXTURE ASSEMBLY

BACKGROUND OF THE INVENTION (1) Field of the Invention

The invention pertains to a lighting fixture mountable from a suspensory surface.

(2) Brief Description of the Prior Art

Light fixtures, such as incandescent, fluorescent, and the like, are well known to those skilled in the art. Such fixtures normally contain one or more bulbs and can be mounted in the fixture for any number of commercial, industrial and home applications. Many such lighting fixtures find particular application when mounted in or from a ceiling or a structure including T-bar assemblies extending from or mounted just below the ceiling. However, such fixtures may also be positioned from, along on or in a wall, floor, table, or the like, all hereinafter referred to as "suspensory surfaces".

Typically, these lighting fixtures, including those generally described above, contain a "ballast" including a housing therefore. The ballast is the electrical component mechanism, which may contain transducers and the like for receipt of electrical current and transmission thereof in converted voltage and the like through the connector and to the fluorescent or other bulb for actuation purposes. The ballast assembly is typically positioned on one side of a framework and may be assembled within the framework as a component during manufacture or partially of completely provided as necessary during assembly and/or mounting of the lighting fixture to accommodate special features and needs. Often times, the configuration of the ballast and housing within the frame work causes difficulty in correctly mounting the lighting fixture relative to suspensory surfaces, especially when using pendant wires and the like. Since the ballast assembly is located on only one side of the frame in atypical configuration, it is difficult for the fixture to be mounted such that it is in exact horizontal alignment with the suspensory surface, such as a ceiling. Typically, one side or the other will be off horizontal or vertical alignment to some extent.

The present invention addresses the problems set forth above.

SUMMARY OF THE INVENTION

The lighting fixture is provided for mounting from a suspensory surface, such as through use of pendant wires, or the like. The lighting fixture includes means for mounting the fixture from the ceiling. A frame having side members is carried by the mounting means. A series of bulb receiving sockets are mounted within the frame. Ballast means in a housing are placed within one side member of the frame and in electric actuatable communication with the sockets. A selectively operable counterbalance means is carried on another of the side members for moving the center of gravity in the fixture to counter the weight of the ballast means during mounting of the fixture relative to the suspensory surface.

DESCRIPTION OF THE PREFERRED EMBODIMENTS

Figure 1:
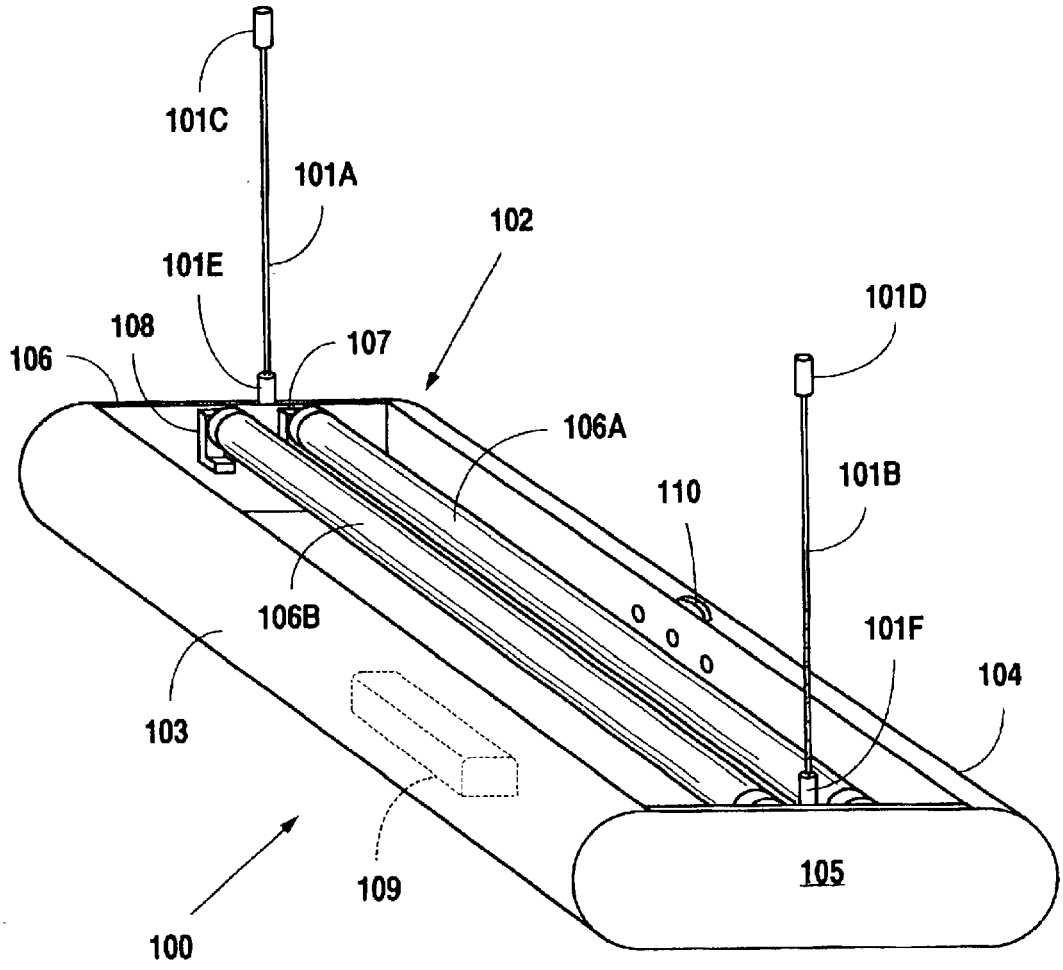
FIG. 1 is a perspective view illustrating the lighting fixture and pendant wires for affixation to a ceiling (not shown).
Figure 2:
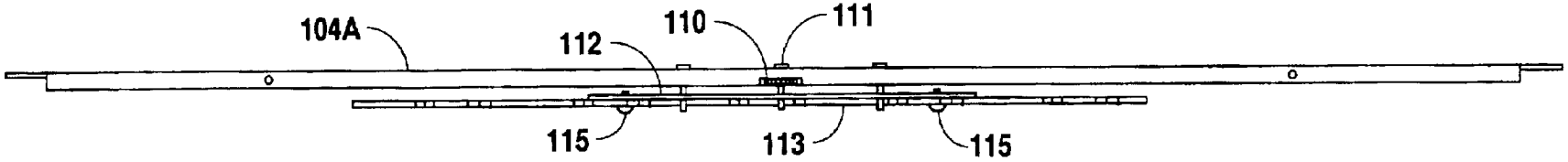
FIG. 2 is a view looking down upon the counterweight system of FIG. 1.
Figure 3:
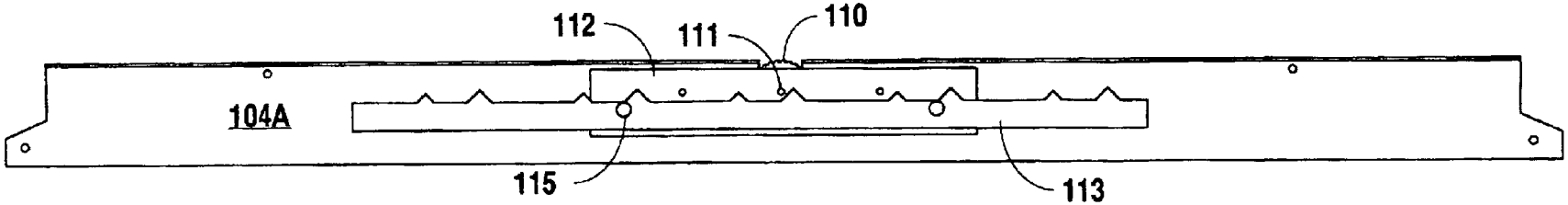
FIG. 3 is a side view similar to that of FIG. 2.

Now referring to FIG. 1, there is shown a fixture 100 extending from pendant wires 101*a* and 101*b*. Pendant wire 101*a* has upper connecting end 101*c* for affixation through or to the ceiling (not shown). Likewise, pendant wire 101*b* has companion end 101*d*, for like purpose. Pendant wire 101*a* has an opposed end 101*e* for affixation, such as by threads, or the like, through the upper most surface and end plate member 106 of the fixture 100. Likewise, pendant wire 101*b* has lower end 101*f* secured to the end plate 105. The series of fluorescent bulb sockets 107 and 108 are provided in the end plate 106, and companion sockets (not shown) are provided in end plate 105 for receipt of first and second fluorescent bulbs 106*a* and 106*b*, respectively.

The fixture 100 also has a parallel side member 103 secured to each end plate 105, 106 and an opposing parallel side member 104 also secured at each end thereof to the plates 105, 106. A ballast housing 109 is placed in or on the parallel side member 103, opposing or facing parallel side member 104. The parallel side members 103, 104 and the end plates 105 and 106 provide the frame 102 of the fixture 100.

Figure 4:
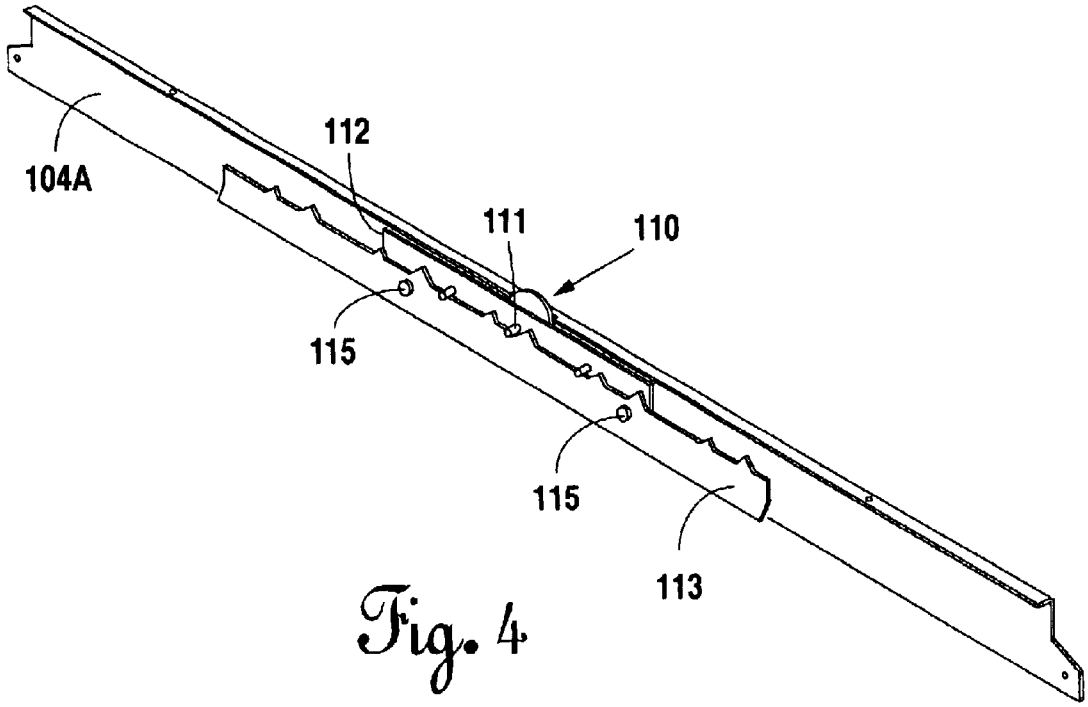
FIG. 4 is a perspective illustration showing the counterweight configuration.
Figure 5:
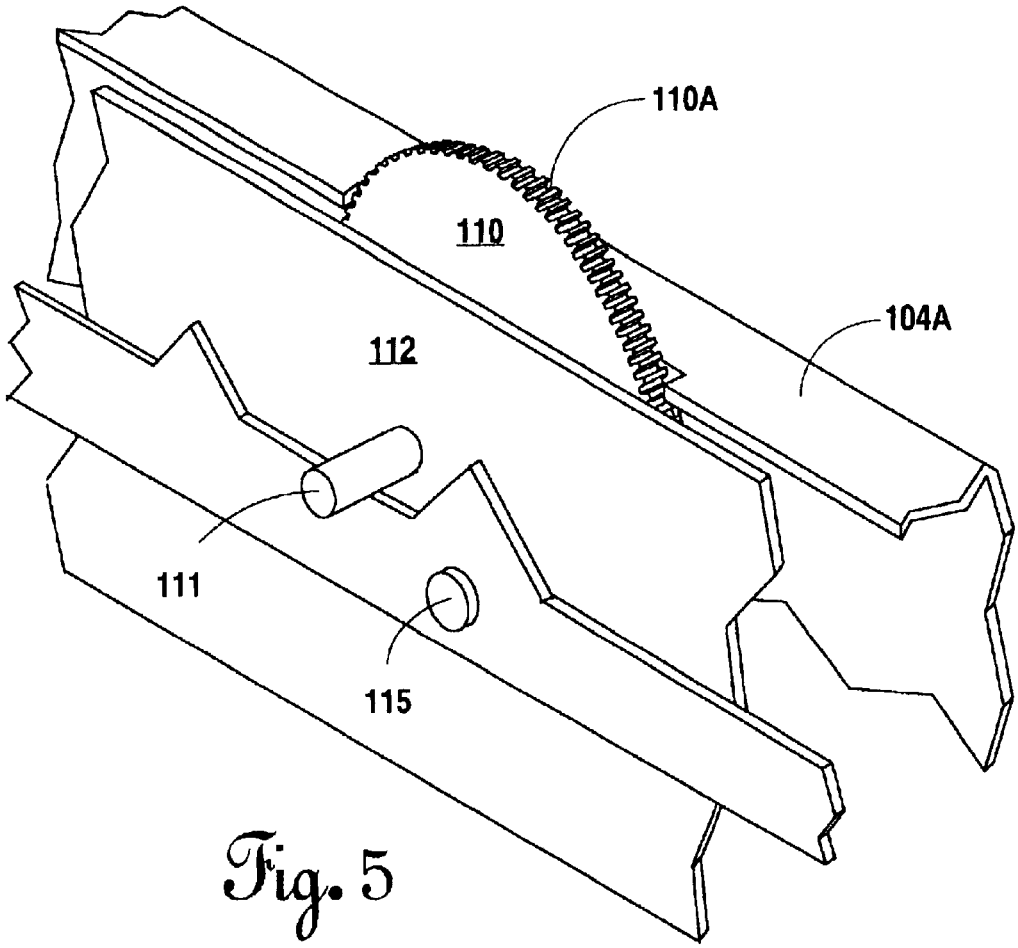
FIG. 5 is a view similar to that of FIG. 4 and constitutes a blow-up of portions of the counterweight system shown in FIG. 4.

Now with reference to FIG. 4, which may be a wire way cover for electrical wire carried in the fixture 100, or which may simply be the interface of the parallel side member 104, contains an elongated moveable counter weight assembly attached to 112. Mounting plate 112 has counterweight 113 attached to it by weld, screws or the like 115. Specific shape of 113 is not important. 113 may be scrap metal from other factory process. Adjustment wheel 110 may have gear teeth as shown, 110A or be smooth and is attached to adjustment screw 111 which extends through a treaded hole in mounting plate 112. The wheel 110 is controlled by turning clockwise or counter-clockwise by a human operator's thumb, or the like.

Now with reference to FIG. 4, parallel side member 104, which may be a wire way cover for electrical wire carried in the fixture 100, or which may simply be the interface of the parallel side member 104, contains and elongated moveable counterweight 112 exposed between the parallel side member 104*a*, and a mounting plate 113 secured to the side member 104*a* by weld, screws, or the like 115. The wheel 110 may have an etched surface or the like or controlled application of the adjuster 110 by a surface of a human operator's thumb, or the like.

Operation

When it is desired to secure the fixture of pendant wires or the like to the ceiling, the ballast 109 is properly configured with the appropriate electronics. Pendant wires 101*a* and 101*b* are secured at one end 101*e* and 101*f* to the respective end plates 106 and 105 of the frame 102. The other end of the connecting pendants 101*c* and 101*d* of the wires 101*a* and 101*b* are secured to or through the ceiling configuration by the human installer. At this juncture, the fluorescent bulbs 106*a* and 106*b* may be installed, if not previously installed into the fixture 100. Thereafter, the human operator may rotate the adjuster wheel 110 clockwise or counter-clockwise to initiate the assessment of the center of gravity of the fixture 100. As the adjuster wheel 110 is rotated, the control screw 111 will transmit this rotational movement to correspondently move counterweight 112 relative to the mounting plate 113. The mounting plate 112 may be moved, if necessary relative to the counter weight 113, by removing and replacement of the securing pins 115.

Thereafter, the human operator may rotate the adjuster wheel 100 clockwise or counter-clockwise to initiate the assessment of the center of gravity of the fixture 100. As the adjuster wheel 110 is rotated, the control screw 111 will transmit this rotational movement to correspondently move the counterweight assembly 112 relative to 104A.

Although the invention has been described in terms of specified embodiments which are set forth in detail, it should be understood that this is by illustration only that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by letters patent is:

1. A lighting fixture for mounting relative to a suspensory surface, comprising:

(1) means for mounting the fixture from the suspensory surface;

(2) a frame having first and second side members carried by the mounting means;

(3) at least one bulb-receiving socket mounted within said frame;

(4) ballast means placed within said first side member of said frame and in electric actuatable communication with said socket; and (5) selectively operable counterbalance means carried on another of the side members for transferring the center of gravity in said fixture to counter the weight of said ballast means during mounting of the fixture relative to the suspensory surface, said counterbalance means further including:

(a) a hand-manipulatable adjuster held in fixed position relative to one of said side members;

(b) a control extending from said adjuster;

(c) a counterweight carried by said control and moveable relative to said ballast by manipulation of said adjuster;

(d) a plate secured to said second side member, for mounting said counterweight for movements therealong; and (e) means on said control and said plate for transferring movements of adjuster to said plate to move said counterbalance in directions relative to said ballast for equalization of the weight of said frame and correct horizontal or vertical adjustment of said fixture relative to said suspensory surface.

2. The fixture of claim 1, wherein the mounting means includes a plurality of pendant wires, each wire having one end secured to the frame and another end extending from the ceiling.

3. The fixture of claim 1, wherein the bulb receiving socket includes a housing for receipt of a fluorescent bulb.

4. The fixture of claim 1, wherein the suspensory surface is a ceiling.

5. The fixture of claim 1, in which the side members are parallel to one another.

* * * * *